US010645476B2

(12) United States Patent
Miskin et al.

(10) Patent No.: US 10,645,476 B2
(45) Date of Patent: May 5, 2020

(54) CHAIR MOUNTABLE AUDIO AND CHARGING SYSTEM FOR MOBILE AND PORTABLE ELECTRONIC DEVICES

(71) Applicant: METIME AUDIO, LLC, Sleepy Hollow, IL (US)

(72) Inventors: Michael Miskin, Sleepy Hollow, IL (US); Valerie Miskin, Sleepy Hollow, IL (US); Michael Miskin, Jr., Sleepy Hollow, IL (US); Matthew Miskin, Sleepy Hollow, IL (US)

(73) Assignee: METIME AUDIO, LLC, Sleepy Hollow, IL (US)

( * ) Notice: Subject to any disclaimer, the term of this patent is extended or adjusted under 35 U.S.C. 154(b) by 0 days.

(21) Appl. No.: 14/889,495

(22) PCT Filed: May 7, 2014

(86) PCT No.: PCT/US2014/037203

§ 371 (c)(1),
(2) Date: Nov. 6, 2015

(87) PCT Pub. No.: WO2014/182851

PCT Pub. Date: Nov. 13, 2014

(65) Prior Publication Data

US 2016/0119700 A1 Apr. 28, 2016

Related U.S. Application Data

(60) Provisional application No. 61/855,050, filed on May 7, 2013, provisional application No. 61/964,215, filed on Dec. 23, 2013.

(51) Int. Cl.
*H04R 9/06* (2006.01)
*H04R 1/02* (2006.01)
(Continued)

(52) U.S. Cl.
CPC ..... *H04R 1/025* (2013.01); *H04R 1/323* (2013.01); *H04R 1/44* (2013.01); *H04R 5/023* (2013.01); *H04R 2420/07* (2013.01)

(58) Field of Classification Search
CPC . H04R 5/023; H04R 3/12; H04R 1/02; H04R 1/026; A61H 2201/0138; A47C 1/12
(Continued)

(56) References Cited

U.S. PATENT DOCUMENTS 4,075,438 A * 2/1978 Kappel ..... H04R 5/023 381/301
D250,711 S 1/1979 Persson et al.
(Continued)

FOREIGN PATENT DOCUMENTS

EP 249428 A2 12/1987

OTHER PUBLICATIONS

International Search Report and Written Opinion of related International App. No. PCT/US2014/037203 dated Sep. 2, 2014, 9 pages.

(Continued)

*Primary Examiner* — George C Monikang
(74) *Attorney, Agent, or Firm* — Schroeder Intellectual Property Law Group, LLC

(57) ABSTRACT

A portable chair mountable audio system having at least one wireless speaker capable of wirelessly connecting to a mobile electronic device and a fixture for housing the at least one wireless speaker. The fixture includes a mounting element for mounting the fixture to a backrest of a chair, the mounting element being capable of allowing the fixture to be mounted at any position along the backrest of the chair.

32 Claims, 6 Drawing Sheets

(51) Int. Cl.
*H04R 5/02* (2006.01)
*H04R 1/32* (2006.01)
*H04R 1/44* (2006.01)

(58) Field of Classification Search
USPC ..... 381/87, 332, 333, 334, 335, 336
See application file for complete search history.

(56) References Cited

U.S. PATENT DOCUMENTS

| | | | | |
|---|---|---|---|---|
| D277,630 | S | 2/1985 | Olson et al. | |
| 5,687,249 | A | 11/1997 | Lancon | |
| 5,832,024 | A | 11/1998 | Schotz et al. | |
| 6,234,446 | B1 * | 5/2001 | Patterson | B64D 11/0015 224/201 |
| 6,289,538 | B1 | 9/2001 | Fidge | |
| 6,721,430 | B2 | 4/2004 | Wang | |
| 7,438,355 | B2 | 10/2008 | Pedemonte | |
| 7,909,406 | B2 | 3/2011 | Samuelsen | |
| 8,130,987 | B2 | 3/2012 | Kaneda et al. | |
| 8,155,368 | B2 | 4/2012 | Cheung et al. | |
| 8,345,889 | B2 | 1/2013 | Li | |
| D691,586 | S | 10/2013 | Clark | |
| 8,654,997 | B2 | 2/2014 | Meehan et al. | |
| 2002/0126863 | A1 * | 9/2002 | Wang | H04R 5/023 381/301 |
| 2004/0007907 | A1 * | 1/2004 | DiRe | A61C 19/00 297/217.3 |
| 2006/0071513 | A1 | 4/2006 | Pedemonte | |
| 2006/0269068 | A1 * | 11/2006 | Yokota | H04R 5/023 381/1 |
| 2006/0285697 | A1 * | 12/2006 | Nishikawa | G10K 11/1788 381/71.1 |
| 2007/0256872 | A1 * | 11/2007 | Yamamuro | A61G 5/045 180/65.51 |
| 2008/0187156 | A1 * | 8/2008 | Yokota | H04R 1/025 381/307 |
| 2009/0154737 | A1 * | 6/2009 | Ostler | A47C 7/72 381/301 |
| 2009/0254011 | A1 * | 10/2009 | Chi | A47C 7/72 601/134 |
| 2009/0268923 | A1 | 10/2009 | Li | |
| 2011/0123038 | A1 | 5/2011 | Clark | |
| 2011/0228959 | A1 | 9/2011 | Meehan et al. | |
| 2012/0250924 | A1 * | 10/2012 | Nicholson | H04R 1/02 381/334 |

OTHER PUBLICATIONS

Brookstone—Beach Lounger Pack Chair with Speakers and Digital Amplifier; http://www.brookstone.com/beach-lounger-pack-chair-with-speakers-and-digital-amplifier/809699p.html (Archived Jan. 25, 2013.

Sharper Image—Speakers for Wheeled Beach Chair/Lounger http://www.sharperimage.com/si/view/product/Speakers+for+Wheeled+Chair%2FLounger/20122 (Accessed Jan. 18, 2016).

* cited by examiner

CHAIR MOUNTABLE AUDIO AND CHARGING SYSTEM FOR MOBILE AND PORTABLE ELECTRONIC DEVICES

RELATED APPLICATIONS

The present application is a U.S. National Phase of International Application No. PCT/US2014/037203 filed May 7, 2014, which claims priority to U.S. Provisional Application No. 61/855,050 entitled "Portable Chair Mountable Audio System for Mobile Electronic Devices Method and Apparatus" filed May 7, 2013; and U.S. Provisional Application No. 61/964,215 entitled "Portable Chair Mountable Audio System for Mobile Electronic Devices Method and Apparatus" filed Dec. 23, 2013; the contents of all of which are expressly incorporated herein by reference.

TECHNICAL FIELD

The present invention generally relates to audio systems for mobile and portable electronic devices having charging and power capabilities. The present invention more specifically relates to a chair mountable solar powered charging and audio systems for mobile and portable electronic devices.

FEDERALLY SPONSORED RESEARCH OR DEVELOPMENT

None.

BACKGROUND OF THE INVENTION

Mobile electronic devices have rapidly evolved over the past several years. Portable handheld radios that were once capable of providing audio output of received broadcast radio signals have been replaced with PMP or MP3 audio players, many of which have radios integrated within them. A portable media player (PMP) or digital audio player (DAP) is a consumer electronics device that is capable of storing and displaying digital media such as audio, video, images, and documents. Data is typically stored on a hard drive, Microdrive, or a flash memory. In contrast, analog portable audio players play music from cassette tapes, records, or discs. Often digital audio players are sold as MP3 players, even if they support other file formats. Other types of electronic devices like cellphones or smart phones, tablet and laptop computers, and digital cameras may be referred as PMPs because of playback capabilities. Mobile and smart phones have advanced significantly since the release of the first cell phone technology and what was initially released as a portable phone that could be taken out of the home into the car solely for the purposes of making phone calls, has turned into a handheld computer having more processing power, capability, and features than early personal computers.

In order to allow for continued and mobile use of mobile electronic devices, chargers which provide power to the device may be utilized. Chargers for mobile electronic devices come in many forms including plug in, solar powered chargers, portable charges that plug into transportation vehicles, and battery operated rapid portable chargers. It is common for mobile electronic devices to run out of power and stop working while being used in outdoor areas, like for example when sitting outdoors in an outdoor type chair. Many times, a power outlet or other method of charging will not be available near the outdoor chair to allow the consumer to continue using the mobile electronic device for music, video, phone calls or other uses.

Chairs for outdoor leisure may be embodied in many forms including but not limited to, patio and deck, pool side, and beach chairs. Some of these chairs are solid and configured in a fixed position, while some may be adjustable for comfort, or foldable for portability. Outdoor chairs can be used during both day and night, in all types of terrain, and weather including rain, snow, cloudy weather, and sunshine.

Mobile electronic devices may be used while sitting in a beach chair or the like, and a user may not be able to handle the mobile electronic device due to sand, water, and/or sun lotion that may be on the consumer's hands. Such terrain or weather may prevent the consumer from interfacing with the mobile electronic device in several ways, such as placing and removing head phones, controlling volume, selecting audio or video for playback, or other interfacing activity.

As mentioned, when used outdoors, and in an outdoor chair, headphones and/or ear buds may often be used in place of built in speakers allowing the user of the mobile electronic device to avoid broadcasting audio to other people nearby that may not wish to hear it. The use of headphones or ear buds may provide additional problems in some weather or terrain if the user needs to repeatedly interface with the headphones and has dirt, sun lotion, sand or water on the hands. This can dirty, contaminate and/or damage the mobile electronic device and/or headphones. Headphones and ear buds also restrict the user of these devices from sufficiently hearing ambient sound which in many cases is desirable or even needed.

Portable speakers may be used with mobile electronic devices as an alternative to headphones in such environments, however, existing prior art portable speaker designs for mobile electronic devices are not designed to mount on outdoor chairs. Existing speakers would need to be placed on the ground near the chair, or on the foot of the chair if it is a long outdoor lounge chair and provides the required additional space. The prior art portable speakers used in such a way do not provide the user with a good method of listening to music or other audio output with the degree of privacy that headphones do. Additionally, existing speakers may provide a nuisance to other people located near the individual using existing speakers as others would be subjected to hearing the audio output from the portable speakers. In order to have privacy and avoid becoming a nuisance to those around them, the user of the mobile electronic device and portable audio speakers generally has to place the speakers near their head and/or ears at low volume or leave them distant and turn the volume down on the audio output to a level that may also prevent the user themselves from hearing the audio output at a desired level of sound.

The present invention is provided to solve these and other issues.

SUMMARY OF THE INVENTION

Accordingly, the present invention aims to provide a portable chair mountable audio system for sound producing devices or mobile electronic devices. The portable chair mountable audio system may be capable of being mounted to chairs and can be adjusted to mount to various locations on chairs, and specifically any location located along the backrest of chairs, preferably proximate a user's head. The positioning of the at least one speaker proximate the user's head should be proximate a user's head when they are sitting back in the chair to which the portable chair mountable audio system is mounted. Spatially locating the speakers proximate the user's ears when mounted allows for the sound to be heard by a user when the sound is at a low volume like with headphones, while allowing the user to be able to still hear ambient sounds and not have to deal with inserting and removing headphones to maneuver or use electronic devices, and without those around them being able to hear the music.

The mounting may also be capable of mounting to various sizes of chairs or chair elements. In order to provide charging or power capabilities, the system may include a rechargeable battery with common recharging methods such as a portable battery charger with a USB connector or cable or other cable connector, or wireless inductive chargers. A solar cell or other solar power source capable of utilizing solar energy to create and provide power may also be provided as part of the system. Sound producing devices and mobile and portable electronic devices may include, for example, PMPs, MP3 players, DAPs, smart phones and cell phones, portable computers, like for example laptops or tablet computers, and portable radios which are digital or otherwise. Of course it is contemplated that the systems herein may be utilized with sound producing devices which are non-mobile electronic devices, like for example desktop computers, televisions, or the like. Essentially, the audio system described herein is capable of use with any device capable of producing sound.

Any speakers utilized in such systems may be designed in such a way to allow for directional and local audio output. With proper design considerations, the audio output from a speaker may be controlled to a narrowed angle of audio distribution that is more focused towards a given direction.

According to one aspect of the invention, a portable chair mountable audio system is provided. The portable chair mountable audio system includes at least one wireless speaker capable of wirelessly connecting to a mobile electronic device, and a fixture for housing the at least one speaker. The fixture may include a mounting element for mounting the fixture to a backrest of a chair. The mounting element may be configured to allow the fixture to be mounted at any position on the backrest of the chair. The fixture may be weather resistant, as well as sealed to particulate matter and waterproof or water resistant.

According to another aspect of the invention, the portable chair mountable audio system may include at least two speakers, at least one speaker being wireless or having wireless capabilities. The at least two speakers may be housed within the fixture. The fixture may also include at least two removable speaker covers which are capable of removable and replacement within the fixture, proximate the at least two speakers. At least one of the at least two removable speaker covers may be configured to effect, manipulate, block, or direct the sound output of at least one speaker.

The at least two speakers may both be wireless, and may be electrically and may be separated by a distance of at least twelve inches. Electrical connection may be accomplished using standard wires or other electrical connectors known in the art.

The fixture may also be configured such that the audio output of each of the at least two speakers is at least partially directed towards the other speaker. The direction of the audio output of each of the at least two speakers may be altered by manipulating the fixture. The distance the at least two speakers are separated may be adjustable so as to increase or decrease the distance between the speakers.

According to another aspect of the invention, the fixture may be capable of securing a towel to a chair to which the fixture is mounted.

According to another aspect of the invention, the mountable audio system may include at least one charging system for powering and charging the at least one speaker and any connected sound producing device. The at least one charging system may be located remotely from the fixture or integrated with the fixture.

In order to electrically connect the mountable audio system to a mobile or portable electronic device, at least one power cable may be included in the system. Electrical connectors may also be provided to connect the at least one charging system to the at least one wireless speaker. The wire connecting the at least one charging system to the at least one wireless speaker may be housed within the fixture. The mountable audio system may further include at least one rechargeable battery. The at least one rechargeable battery may be configured to provide power to the at least one wireless speaker and may be connected to, and capable of being, recharged by the at least one charging system. The at least one charging system may be any system known in the art, including, but not limited to, a solar powered charging system.

According to, another aspect of the invention, whether one, two, or more speakers are used in the system, at least one speaker may be configured to provide a directional audio output. At least one speaker may also be capable of having the direction of its audio output manipulated. Additionally or alternatively, the fixture may be manipulated so that the direction of the audio output of at least one speaker housed within the housing may be adjusted.

According to another aspect of the invention, the mountable audio system may further include a portable or mobile electronic device housing. At least a portion of sound producing device housing may be clear, pliable, or both, and the sound producing device housing may be weather resistant as well as sealed to particulate matter and water resistant or water proof. The sound producing device housing may be separate from the fixture, or integrated with the fixture.

According to another aspect of the invention, the mounting element may be adjustable. The mounting element may be one or more of at least one strap, at least one bracket, Velcro, at least one a clip, at least one hook, and at least one suction cup.

According to another aspect of the invention, the fixture may be flexible. For example, the fixture may be constructed from silicon rubber or may be a pillow.

According to another aspect of the invention, the mountable audio system may include an antenna which may be integrated with the fixture.

According to another aspect of the invention, the at least one wireless speaker may include a device for connecting the at least one speaker to a sound producing device. The at least one speaker may utilize Bluetooth protocols or other wireless technology to wirelessly connect to a sound producing device.

The portable chair mountable audio system may also include at least one audio cable, the at least one audio cable being capable of connecting the at least one wireless speaker to a sound producing device. The at least one audio cable may be removable or retractable, and may be capable of being at least partially housed within the fixture.

According to another aspect of the invention, the portable chair mountable audio system may include a head rest. The head rest may be integrated with the fixture.

According to another aspect of the invention, the portable chair mountable audio system may include a pivot point. The pivot point may be formed as part of the fixture and allow the fixture to be folded or reduced in size for storage or travel.

Other aspects and features of the invention will become apparent to those having ordinarily skill in the art upon review of the following Description, Claims, and associated Drawings.

DETAILED DESCRIPTION OF PREFERRED EMBODIMENTS

While this invention is susceptible to embodiments in many different forms, there is described in detail herein, various embodiments of the invention with the understanding that the present disclosures are to be considered as exemplifications of the principles of the invention and are not intended to limit the broad aspects of the invention to the embodiments illustrated.

As discussed throughout, it should be understood that the various elements of the portable chair mountable audio system shown in figures and described herein may be combined or used together without limitation. Any of the features shown as being part of any portable chair mountable audio system may be utilized with any other features, regardless of whether or not such combination is directly disclosed.

Figure 1:
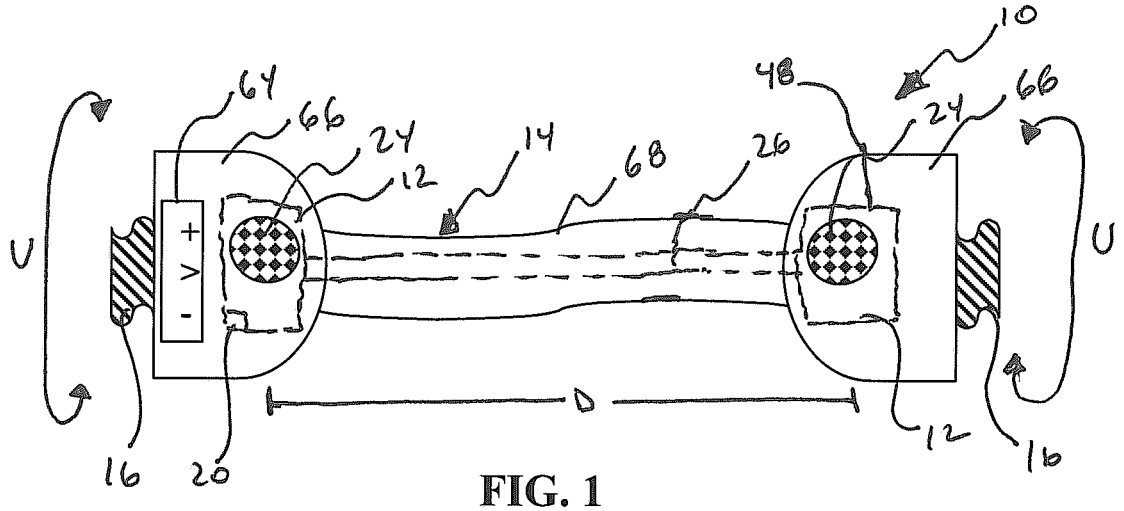
FIG. 1 shows an embodiment of a portable chair mountable audio system.
Figure 2:
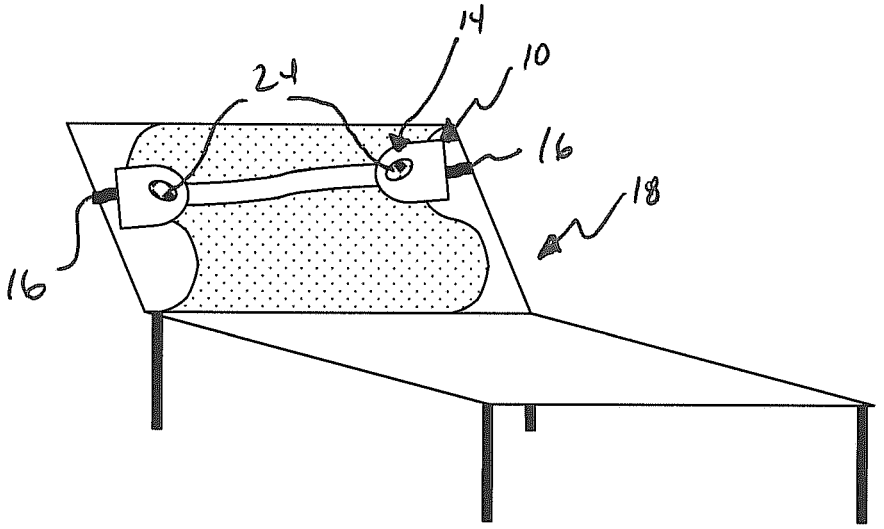
FIG. 2 shows the portable chair mountable audio system of FIG. 1 mounted to the backrest of a chair.

FIG. 1 shows portable chair mountable audio system 10 which has at least one wireless speaker 12 and fixture 14 for housing the at least one wireless speaker 12. Fixture 14 includes a mounting element 16 for mounting portable chair mountable audio system 10 to a chair 18 as seen in FIG. 2. Portable chair mountable audio system 10 may include electronics or device 20 which is capable of connecting the at least one wireless speaker to a mobile electronic device 22, as seen, for example, in FIG. 8A. As seen, device 20 may be incorporated into wireless speaker 12, which may be a wireless speaker system, so that wireless speaker 12, or the wireless speaker system, may wireless communicate with mobile electronic device 22. For example, device 20 may be a Bluetooth technology or other encoded or matchable wireless communications devices or technology capable of connecting the portable chair mountable audio system to a sound producing device or mobile electronics device. Any wireless signal receiving device may be integrated with at least one speaker in the portable chair mountable audio system, or alternatively may be located within fixture 14 and connected to at least one speaker to provide received audio signals for playback. The use of wireless technology allows a user to use their mobile electronic device while audio is played from the device, without having to worry about any cables or wires getting the way.

Though the device may include only one wireless speaker, it is generally preferred that the device includes at least two speakers, at least one of which has wireless capabilities, so that a user may mount the device on a chair backrest or head rest and have sound provided to both ears. As seen in FIGS. 1 and 2, for example, whether one or two, or more, speakers are used, each speaker may be housed within the fixture.

As seen in FIG. 1, portable chair mountable audio system 10 may include removable speaker covers 24 which may be capable of being removed from and replaced on the fixture proximate where each speaker is housed. The removable speaker covers may be separate and distinct from any speakers or covers formed as part of the speakers, and may be designed for fashion or display purposes, like for example to allow for different colors or designs to be integrated with the fixture, or additionally or alternatively may also provide different effects on the sound output from the speaker located proximate the removable speaker cover. For example a removable speaker cover may provide a larger or small area through which sound emitted by any speakers located proximate the cover may pass, may provide a directional output or effect the direction any audio output by a speaker located proximate the removable speaker cover, or may block or entirely prevent audio output from a speaker located proximate the removable speaker cover.

Rather than provide multiple connection devices, portable chair mountable audio system 10 may include an electrical connector 26 housed within fixture 14 which connects speakers 12 together to allow for audio signals received by one speaker to be transmitted to and emitted from both speakers.

Where two speakers are used, the distance between the speakers, and more specifically the distance between the output of the speakers which is donated by D in FIG. 1, should be a great enough distance such that when portable chair mountable audio system 10 is mounted on a chair, a user can easily place their head between the speaker outputs and still have the speakers located proximate their ears to listen to the audio output. This distance should generally be at least twelve inches, and may be designed to more, or in some cases less, in order to accommodate various users. In order to avoid having to purchase multiple devices for multiple users, or require different users to mount different devices to a single chair when the user in the chair changes, fixture 14 may be adjustable to change the position of each speaker relative to each other. For example, if an adult sits in a chair with portable chair mountable audio system 10, the adult may position speakers 12 fourteen inches apart so that their head can comfortably fit between the speakers and their ears can comfortably listen to the audio output from each speaker. If a child later sits in the same chair and wants to use the portable chair mountable audio system, the fixture may allow for speakers 12 to be moved closer together, like for example, to a distance of 10 inches, so that the audio output is positioned closer to the child's ears. In order to provide the movement, fixture 14 may be flexible or may allow for the movement of any portion housing a speaker or a portion of the fixture itself. For example, portions 66 of fixture 14 may be capable of sliding or otherwise moving along portion 68. This will allow the speakers to be brought closer together or spaced further apart. Additionally, the audio output level of speakers 12 may be controlled utilizing volume controls 64 provided on fixture 14.

Figure 3A:
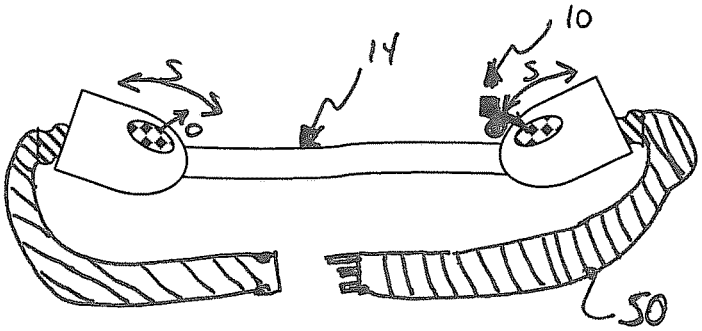
FIG. 3A shows a top view of the portable chair mountable audio system in FIG. 1 with a mounting element and connector.

As seen in FIG. 3A which shows a top view of an embodiment of portable chair mountable audio system 10, where two speakers are used, fixture 14 may be configured such that the audio output direction O of each of the at least two speakers may be directed at least partially towards the other speaker. Configuring fixture 14 in this manner provides audio output from each speaker towards a user's ears so that the audio may be received by the user without the audio being audible, or substantially unaudible, to anyone located proximate the user. The direction of the audio output of each speaker may be altered by manipulating the fixture by moving the housing, for example in direction U as shown in FIG. 1, or direction S as shown in FIG. 3A. By manipulating the fixture, the audio output of any housed speakers may be focused, up, down, inwards, outwards, or any combination thereof. In order to provide for manipulation, fixture 14 may be both flexible and resilient so that the fixture can be re-positioned and remain in the new position as desired.

In addition to being flexible and/or resilient, fixture 14 may also be weather resistant or proof, substantially sealed to particulate material like dirt or sand, and waterproof or water resistant, in order to protect the contents of any speakers, devices, and other electronics housed within. In order to achieve these characteristics, fixture 14 may be constructed using any material having such characteristics known in the art, like, for example, various plastics or polymers, rubber, or silicon rubber. Silicon rubber is particularly desirable as it is a material which generally does not increase in temperature which provides for safer use by a user in sunny or hot locations as the material will not heat up and burn their skin, and provides greater protection for any housed devices as the material itself will not heat up.

In addition to the fixture providing a directional audio output and being capable of manipulation to alter the direction of any audio output, speakers 12 may likewise be configured to provide a directional audio output or have the direction of any audio output manipulated or altered. As seen in FIG. 1, for example, speakers 12 may include device 48 which is capable of rotating the speakers or any inner elements within the speaker to alter the directional output of the speaker. In order to provide for directional output and manipulation of the same, speakers 12 may be standard speakers which output sound from a single side or point, or may also include parabolic reflectors or the like to prevent sound from escaping and allow for the manipulation of the direction of any audio output.

Figure 3B:
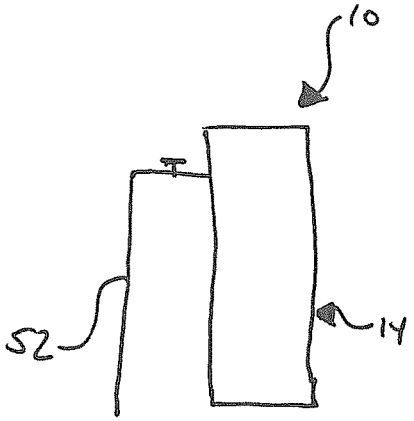
FIG. 3B shows a side view of the portable chair mountable audio system in FIG. 1 with a mounting element and connector.
Figure 3C:
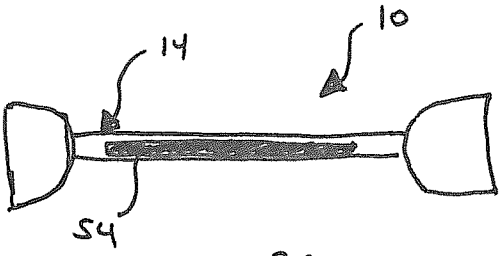
FIG. 3C shows a back view of the portable chair mountable audio system in FIG. 1 with a mounting element and connector.
Figure 3D:
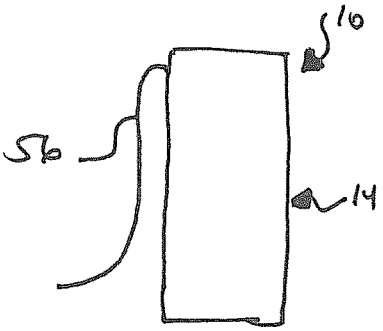
FIG. 3D shows a side view of the portable chair mountable audio system in FIG. 1 with a mounting element and connector.
Figure 3E:
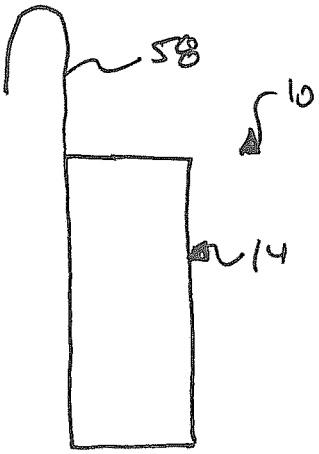
FIG. 3E shows a side view of the portable chair mountable audio system in FIG. 1 with a mounting element and connector.
Figure 3F:
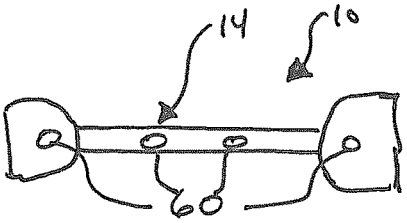
FIG. 3F shows a back view of the portable chair mountable audio system in FIG. 1 with a mounting element and connector.

FIGS. 2 and 3A-3F show various views of audio system 10 and different mounting elements and connectors that portable chair mountable audio system 10 may utilize to mount to a chair backrest. The mounting element and any associated connector may be formed integrally with fixture 14, or may be a connector or multiple connectors which are integrated with fixture 14. Examples of mounting elements which may be used include at least one strap 50 as seen in FIGS. 2 and 3A, at least one bracket 52 as seen in FIG. 3B, Velcro 54 as seen in FIG. 3C, at least one clip 56 as seen in FIG. 3D, at least one hook 58 as seen in FIG. 3E, and/or at least one suction cup 60 as seen in FIG. 3F. Any combination of the aforementioned, or any other known connectors or mounting elements, may be utilized by the portable chair mountable audio system and integrated with, or formed as part of, fixture 14 or as part of any portable chair mountable audio system discussed herein. In addition, mounting element 16 may be adjustable to accommodate different size chairs or different settings.

In addition to providing audio output, fixture 14, including mounting element 16, may be utilized to secure a towel to a chair to which the fixture is mounted. As seen in FIG. 2, when mounted to a chair, fixture 14 and mounting 16 may be utilized to secure towel 62 to the back of chair 18.

Figure 4:
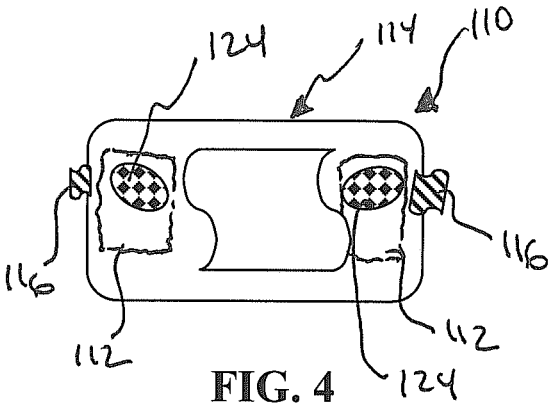
FIG. 4 shows an embodiment of a mountable audio system having a pillow like element formed as part of the fixture.

As seen in FIG. 4, fixture 114 of portable chair mountable audio system 110 may also be formed as a pillow or pillow like structure which is capable of mounting to a chair. When formed as a pillow or pillow like element, fixture 114 may include any of the features discussed herein, like for example speakers 112, mounting element 116, and removable covers 124, but additionally be formed as a pillow to provide greater user comfort.

Figure 5:
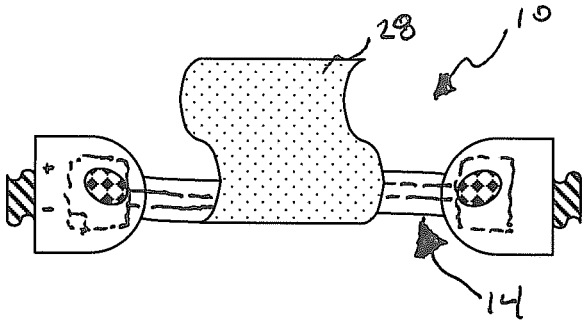
FIG. 5 shows the portable chair mountable audio system of FIG. 1 having a headrest integrated therewith.

In order to provide further user comfort without being formed as a pillow, portable chair mountable audio system 10 may include headrest 28 which is integrated with fixture 14 as seen in FIG. 5. Headrest 28 may be constructed using materials similar to or different from those used for fixture 14, and may also include a cushion or other attachable and removable element which provides protection and greater comfort for the user. Headrest 28 may be incorporated into and used with any of the portable chair mountable audio systems discussed herein.

Figure 6A:
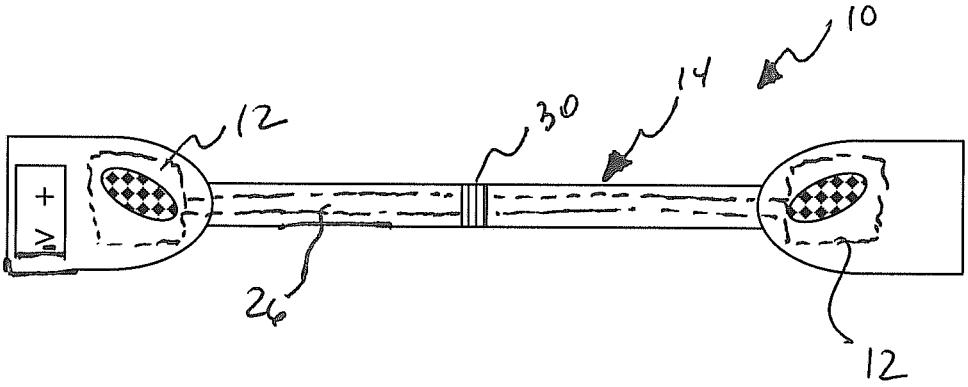
FIG. 6A shows the portable chair mountable audio system of FIG. 1 having a pivot point.
Figure 6B:
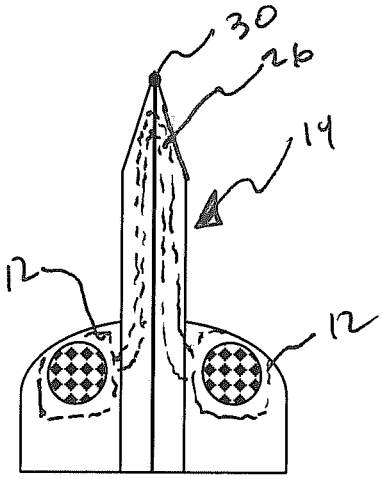
FIG. 6B shows the portable chair mountable audio system of FIG. 6A being folded about the pivot point.

In order to provide greater transporting and storage capabilities, as seen in FIG. 6A, fixture 14 may include pivot point 30 which may allow fixture 14 to be folded or reduced in size for storage or travel, as seen in FIG. 6B. Pivot point 30 may be a joint or hinge formed direction in fixture 14, or may be a discontinuity in fixture 14 with two portions of fixture 14 connected by a hinge element, for example. In embodiments where both a discontinuity and electrical connector 26 is used to connect multiple speakers 12 within a fixture are used, any wires may extend through the discontinuity so as to extend throughout the entire fixture. Pivot point 30 may be incorporated into any of the portable chair mountable audio systems discussed herein.

Figure 7A:
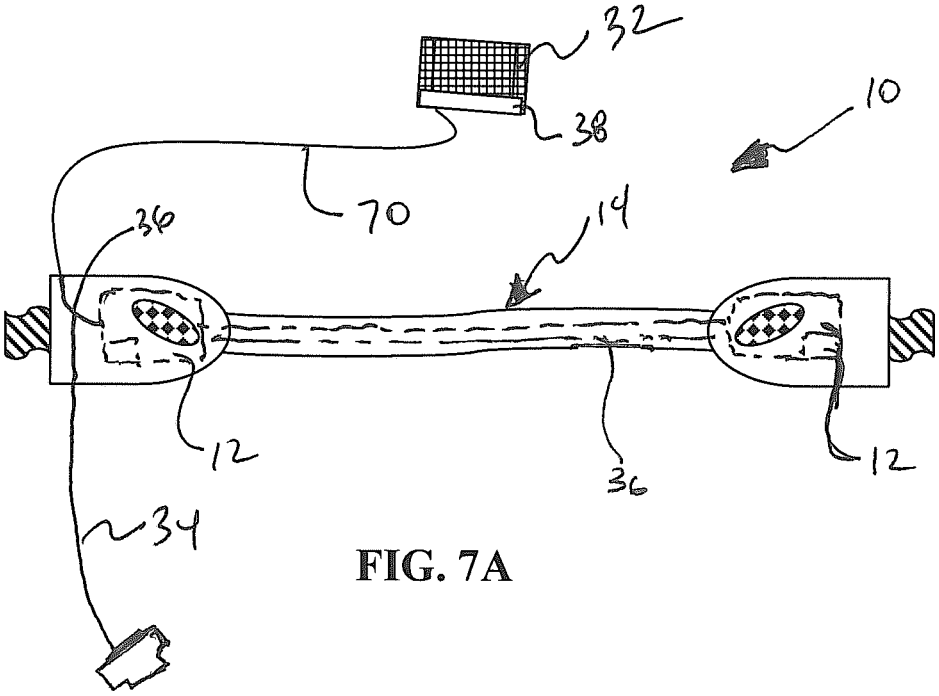
FIG. 7A shows the portable chair mountable audio system of FIG. 1 having a remote charging system connected thereto.
Figure 7B:
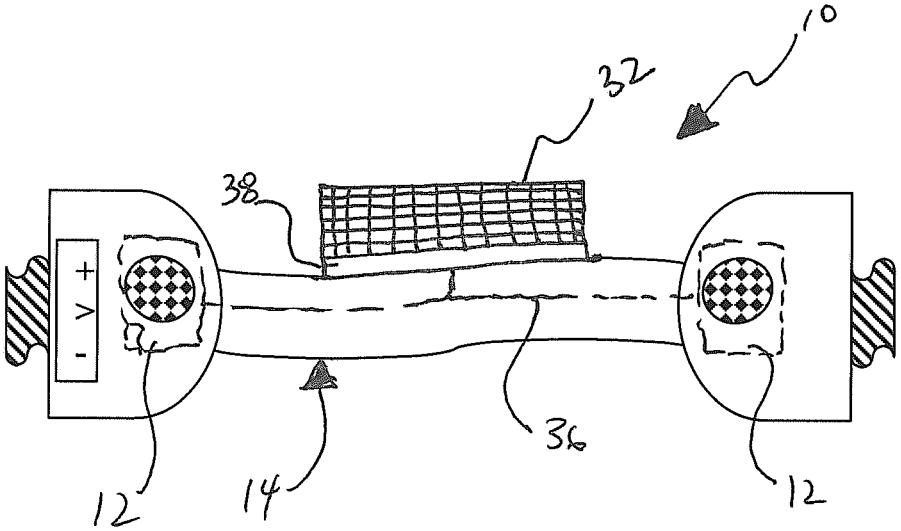
FIG. 7B shows the portable chair mountable audio system of FIG. 1 having a charging system integrated therewith.

As seen in FIGS. 7A and 7B, portable chair mountable audio system 10 may include at least one charging system 32 which may be used to power and charge any speakers 12 in the portable chair mountable audio system, as well as any mobile electronic devices connected to the portable chair mountable audio system. The at least one charging system may be integrated with fixture 14 in any location which will allow for the charging system to work and be connected to any speakers 12 and/or mobile electronic devices. For example, charging system 32 may be mounted to fixture 14 as seen in FIG. 7B, or alternatively, may be mounted to any mounting element configured with the fixture. Alternatively, as seen in FIG. 7A, charging system 32 may be located remotely from fixture 14 and connected thereto using electrical connector 70. Electrical connector 70 may then be electrically connected to any elements used to provide power to speakers 12 or a mobile electronic device.

In order to electrically connect any charging system to a mobile electronic device, portable chair mountable audio system 10 may include at least one power cable 34 as seen in FIG. 7A. Power cable 34 may be a separate cable, as seen in FIG. 7A, or alternatively may be housed within a single sheath with any device connection elements like the audio cord as seen with cable 234 in FIG. 10. In order to provide power to at least one speaker, electrical connector 36 may be housed within fixture 14 and electrically connect power charging system 32 to speakers 12 or speakers 12 to each other.

In addition to a power charging system, in order to provide additional power when power charging system 32 is unavailable or inoperable, rechargeable battery 38 may be included in portable chair mountable audio system 10. Any required wires or connection elements required to connect rechargeable battery 38 to speakers 12 and power charging system 32 for recharging may be housed within fixture 14.

Power charging system 32 may be a solar powered charging system as seen in FIGS. 7A and 7B, or may alternatively be any system known in the art. For example, power charging system 32 may be a plug and driver for connecting to a standard outlet.

It should be understood that any of the elements discussed with reference to charging system 38 and shown in FIG. 7A or 7B may be utilized with any of the various portable chair mountable audio systems discussed herein.

Figure 8A:
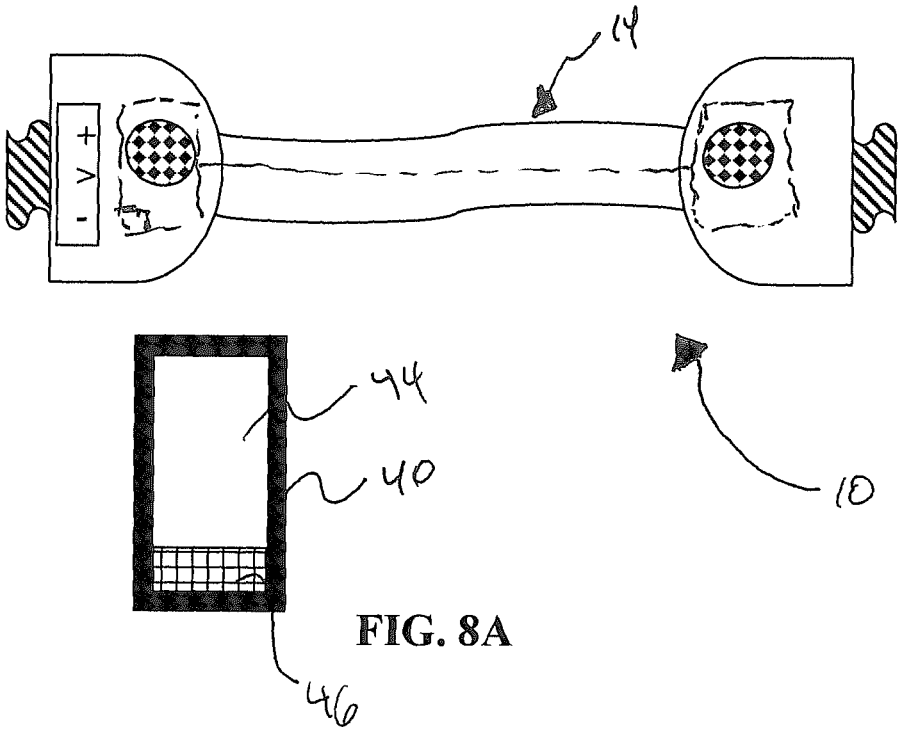
FIG. 8A shows the portable chair mountable audio system of FIG. 1 having a mobile electronic device housing.
Figure 8B:
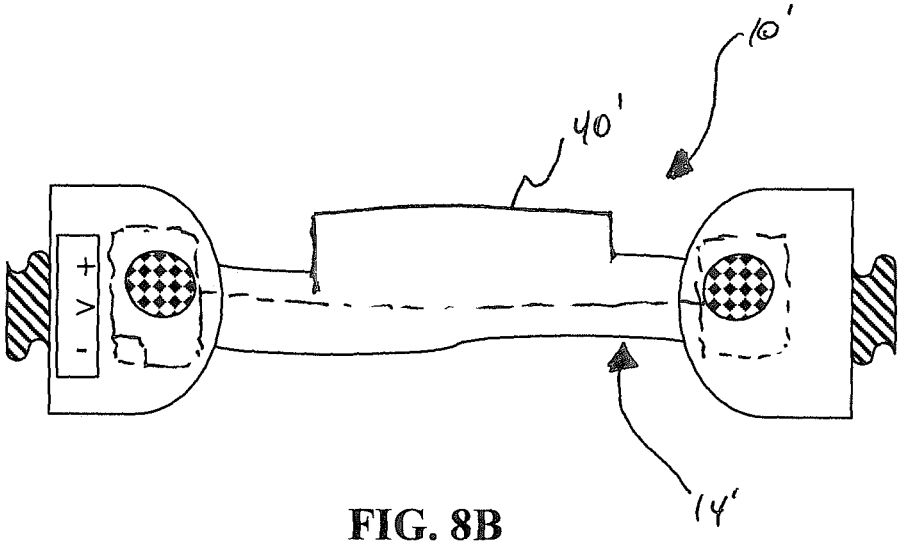
FIG. 8B shows the portable chair mountable audio system of FIG. 1 having a mobile electronic device housing integrated with the fixture.

As seen in FIGS. 8A and 8B, portable chair mountable audio system 10 and 10' may include a sound producing device or mobile electronic device housing 40 and 40'. As seen in FIGS. 8A and 8B, a portion of any sound producing device or mobile electronic device housing 40 and 40' may be clear 44 and/or pliable 46 to allow for the viewing and manipulation of the sound producing device or mobile electronic device housed therein. Like fixture 14, the sound producing device or mobile electronic device housing may be weather resistant or proof, sealed to particulate matter like sand or dirt, and may be water resistant or water proof. As seen in FIG. 8A, sound producing device or mobile electronic device housing 40 may be formed separate from fixture 14, or, as shown in FIG. 8B, housing 40' may be integrated with fixture 14'. A sound producing device or mobile electronic device housing like that shown in FIGS. 8A and 8B may be utilized with any of the portable chair mountable audio systems discussed herein.

Figure 9:
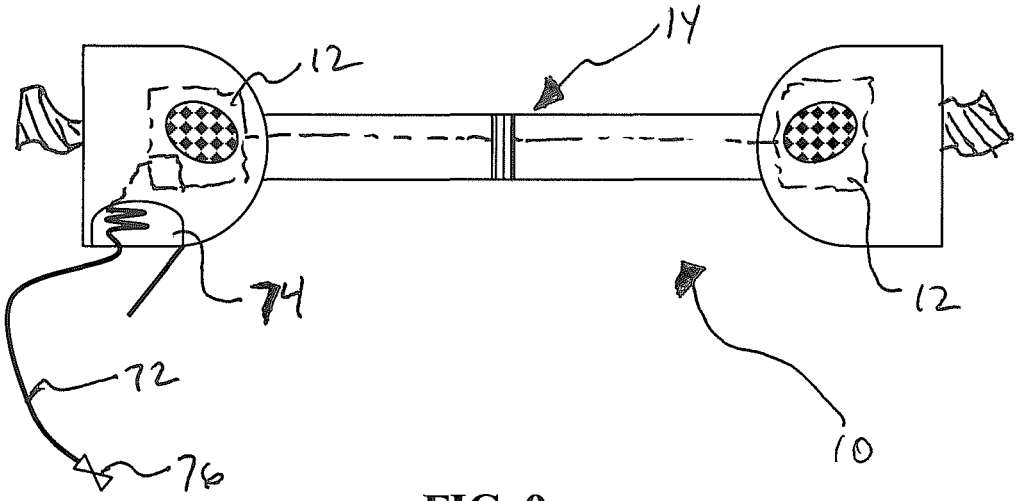
FIG. 9 shows the portable chair mountable audio system of FIG. 1 having an audio cable.

As seen in FIG. 9, in addition to having wireless connecting capabilities, portable chair mountable audio system 10 may include audio cable 72 for connecting speakers 12 directly to a mobile electronic device. Cable 72 may be utilized when wireless capabilities are unavailable or cannot be used, like for example, on an airplane or the like. Cable 72 may be integrated with fixture 14, and directly connected to at least one speaker 12 in the portable chair mountable audio system. Fixture 14 may include a portion 74 for housing cable 72, which may also be retractable. Alternatively, cable 72 may be completely disconnectable or removable from portable chair mountable audio system 10 and may connect to the system or a speaker using a common connector like a USB connector or audio plug. Cable 72 may also include connector 76 for connecting to a mobile electronic device.

Figure 10:
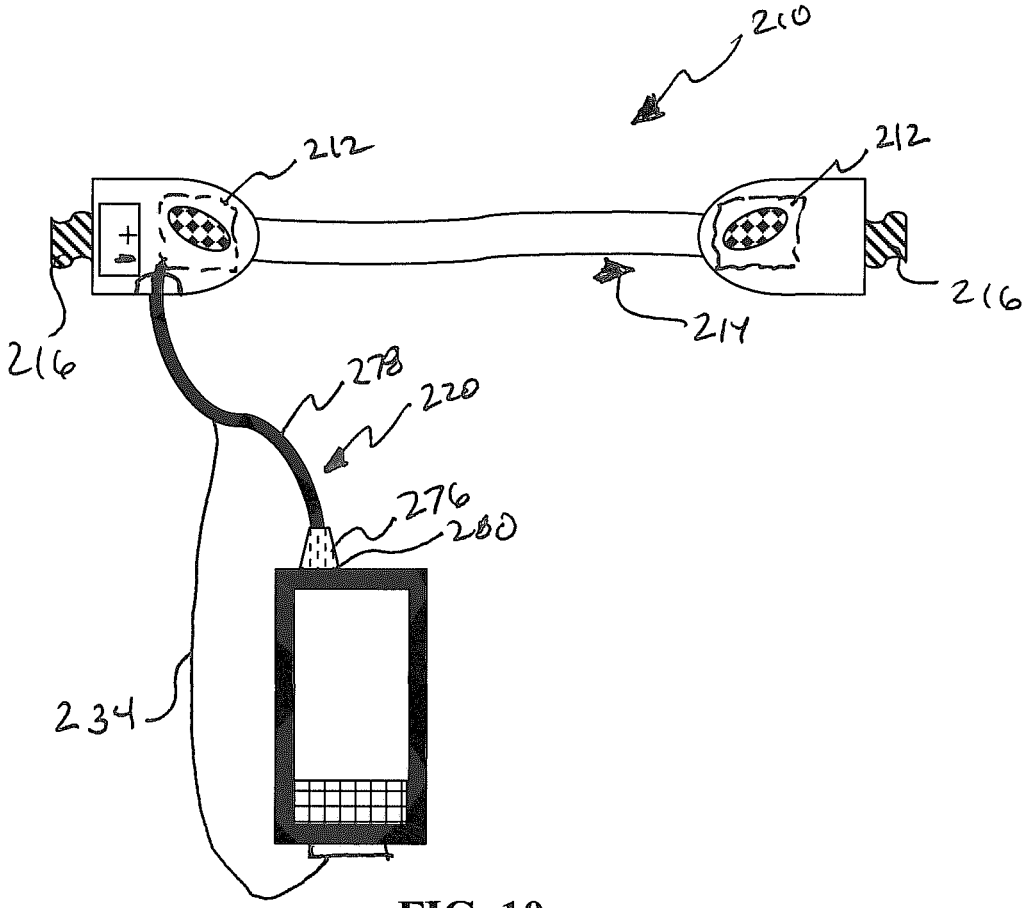
FIG. 10 shows an alternative embodiment of a portable chair mountable audio system.

FIG. 10 shows an alternative embodiment of a portable chair mountable audio system. Portable chair mountable audio system 210 may include at least one speaker 212 housed within housing 214 and have mounting element 216 for mounting the portable chair mountable audio system to the backrest of a chair. Rather than have wireless connection capabilities, device 214 which may be audio cable 278 or the like may be provided to connect the portable chair mountable audio system to mobile electronic device 222. Audio cable 278 may be directly connected to at least one speaker 212, and may have an audio connector 276 capable of connecting to audio jack 280 in mobile electronic device 222. Cable 278 may be integrated with fixture 214 or at least one speaker 212. Fixture 214 may include a housing like that shown in FIG. 9 for storing cable 278, and cable 278 may be retractable. Cable 278 may also be removable, so as to be able to completely disengage from both portable chair mountable audio system and any mobile electronic device when not in use.

While the foregoing there has set forth embodiments of the invention, it is to be understood that the present invention may be embodied in other forms without departing from the spirit or central characteristics thereof. The present embodiments, therefore, are to be considered in all respects as illustrative and not restrictive, and the invention is not to be limited to the details given herein. While specific embodiments have been illustrated and described, numerous modifications come to mind without significantly departing from the characteristics of the invention and the scope of protection is only limited by the scope of the accompanying claims.

What is claimed is:

1. A chair mountable portable wireless audio system comprising:

at least two speakers and electronics capable of wirelessly connecting to a mobile electronic device;

a rechargeable battery for powering the at least two speakers; and a fixture, wherein the fixture is constructed from silicone rubber and wherein the fixture is water resistant or waterproof;

the at least two speakers, electronics, and the rechargeable battery being housed inside the fixture, the fixture comprising a mounting element for adjustably mounting the fixture to a backrest of a chair, the mounting element allowing the fixture to be mounted at any position vertically along the backrest of the chair and removed from the backrest of the chair.

2. The chair mountable portable wireless audio system of claim 1 wherein the fixture is weather resistant.

3. The chair mountable portable wireless audio system of claim 1 further comprising at least two removable speaker covers, the at least two removable speaker covers being capable of being removable and replaced within the fixture.

4. The chair mountable portable wireless audio system of claim 1, wherein the at least two speakers are electrically connected.

5. The chair mountable portable wireless audio system of claim 1, wherein the at least two speakers housed within the fixture are separated by a distance of at least ten inches.

6. The chair mountable portable wireless audio system of claim 5 wherein the distance of at least ten inches the at least two speakers are separated, is adjustable.

7. The chair mountable portable wireless audio system of claim 1, wherein the fixture is configured such that the audio output of each of the at least two speakers is at least partially directed towards the other speaker.

8. The chair mountable portable wireless audio system of claim 7 wherein the fixture is both flexible and resilient so that the fixture can be manipulated to a new configuration and remain in the new configuration after being manipulated, wherein the direction of the audio output of each of the at least two speakers is altered by manipulating and re-configuring the fixture.

9. The chair mountable portable wireless audio system of claim 1, wherein the fixture is capable of securing a towel to a chair to which the fixture is mounted.

10. The chair mountable portable wireless audio system of claim 1 further comprising a mobile electronic device housing.

11. The chair mountable portable wireless audio system of claim 10, wherein at least a portion of the mobile electronic device housing is pliable.

12. The chair mountable portable wireless audio system of claim 10, wherein the mobile electronic device housing is weather resistant.

13. The chair mountable portable wireless audio system of claim 10, wherein the mobile electronic device housing is integrated with the fixture.

14. The chair mountable portable wireless audio system of claim 1, wherein the mounting element is adjustable.

15. The chair mountable portable wireless audio system of claim 1, wherein the mounting element comprises at least one connector from the group consisting of: at least one strap, at least one bracket, Velcro, at least one a clip, at least one hook, and at least one suction cup.

16. The chair mountable portable wireless audio system of claim 1, wherein the fixture is flexible and resilient so that when the fixture is flexed and configured in a new position, the fixture remains in the new position until it is re-configured a second time.

17. The chair mountable portable wireless audio system of claim 16 wherein the fixture is formed in the shape of a headrest.

18. The chair mountable portable wireless audio system of claim 1, further comprising a device for connecting to a device producing a wireless signal.

19. The chair mountable portable wireless audio system of claim 1 further comprising at least one audio cable, the at least one audio cable being capable of connecting the at least two speakers to a mobile electronic device.

20. The chair mountable portable wireless audio system of claim 19 wherein the at least one audio cable is removable.

21. The chair mountable portable wireless audio system of claim 19 wherein the at least one audio cable is retractable.

22. The chair mountable portable wireless audio system of claim 19, wherein the at least one audio cable can be at least partially housed within the fixture.

23. The chair mountable portable wireless audio system of claim 1 further comprising a head rest, the head rest being integrated with the fixture.

24. The chair mountable portable wireless audio system of claim 1 further comprising a pivot point, the pivot point being formed as part of the fixture and allowing the fixture to be folded or reduced in size for storage or travel.

25. The chair mountable portable wireless audio system of claim 1 further comprising at least one charging system for charging the rechargeable battery and any connected mobile electronic device, the at least one charging system being integrated with the fixture.

26. The chair mountable portable wireless audio system of claim 25 further comprising at least one power cable, the at least one power cable being configured to electrically connect the at least one charging system to any mobile electronic device.

27. The chair mountable portable wireless audio system of claim 25 further comprising at least one electrical connector connecting the at least one charging system to the at least two speakers, the at least one electrical connector being housed within the fixture.

28. The chair mountable portable wireless audio system of claim 25 wherein the at least one charging system is solar powered charging system.

29. The chair mountable portable wireless audio system of claim 1 wherein the rechargeable battery is recharged using a wireless charger.

30. The chair mountable portable wireless audio system of claim 1 wherein the fixture includes at least two electrical connectors for connecting to a power source.

31. The portable chair mountable wireless audio system of claim 1, wherein the at least two speakers include a device for connecting the at least one speaker to a sound producing device.

32. A chair mountable portable wireless audio system comprising:

at least two speakers capable of receiving a wirelessly transmitted audio signal;

a rechargeable battery for powering the at least two speakers; and a fixture, the fixture forming a housing for the system such that the at least two speakers and the rechargeable battery are housed inside the fixture, the fixture comprising an integrated mounting element for adjustably mounting the fixture to a backrest of a chair, the mounting element allowing the fixture to be removably mounted at any position vertically along the backrest of the chair, and further wherein the fixture is both flexible and resilient so that the fixture can be manipulated to a new configuration and remain in the new configuration after being manipulated, wherein the direction of the audio output of each of the at least two speakers is altered by manipulating and re-configuring the fixture.

* * * * *